US006036532A

United States Patent [19]

Feistkorn

[11] Patent Number: 6,036,532

[45] Date of Patent: Mar. 14, 2000

[54] ELECTRICAL CONNECTOR WHICH STRIPS INSULATION FROM AN INSULATED CONDUCTOR

[76] Inventor: Vera Feistkorn, Gönnerstrasse 35, 96050, Bamberg, Germany

[21] Appl. No.: 08/945,828

[22] Filed: Jan. 9, 1998

[30] Foreign Application Priority Data

May 4, 1995 [DE] Germany ..... 195 16 338

[51] Int. Cl.[7] ..... H01R 9/07

[52] U.S. Cl. ..... 439/495; 439/393; 439/864; 439/409

[58] Field of Search ..... 439/495, 393, 439/389, 409, 410, 794, 864, 838, 422, 417

[56] References Cited

U.S. PATENT DOCUMENTS

| | | | |
|---|---|---|---|
| 1,977,677 | 10/1934 | Hill | 439/410 |
| 3,877,774 | 4/1975 | Dorrell | 439/409 |
| 4,560,225 | 12/1985 | Margaroli et al. | 439/422 |
| 4,842,545 | 6/1989 | Wilhem | 439/393 |

FOREIGN PATENT DOCUMENTS

| | | |
|---|---|---|
| 904 304 | 2/1954 | Germany . |
| 29 02 536 | 4/1980 | Germany . |
| 29 22 447 | 12/1980 | Germany . |
| 9309058 | 9/1993 | Germany . |

*Primary Examiner*—Paula Bradley
*Assistant Examiner*—Tho D. Ta
*Attorney, Agent, or Firm*—Gilberto M. Villacorta; Corinne M. Pouliquen; Pepper Hamilton LLP

[57] ABSTRACT

This invention relates to a detachable connecting terminal which connects an electric conductor in the form of a wire or strand with an electroconductive contact bar, wherein a pivotedly positioned terminal disk in the housing forces the conductor against the contact bar when swivelled. According to the invention, the terminal disk has a knife which, together with a counter knife at the contact bar, separates the insulation from the conductor upon rotation of the terminal disk and forces the stripped portion of the conductor against the clamping region upon further rotation of the terminal disk. This joint can be separated with a suitable tool by pressing against a locking nose.

10 Claims, 3 Drawing Sheets

DRAWING 1
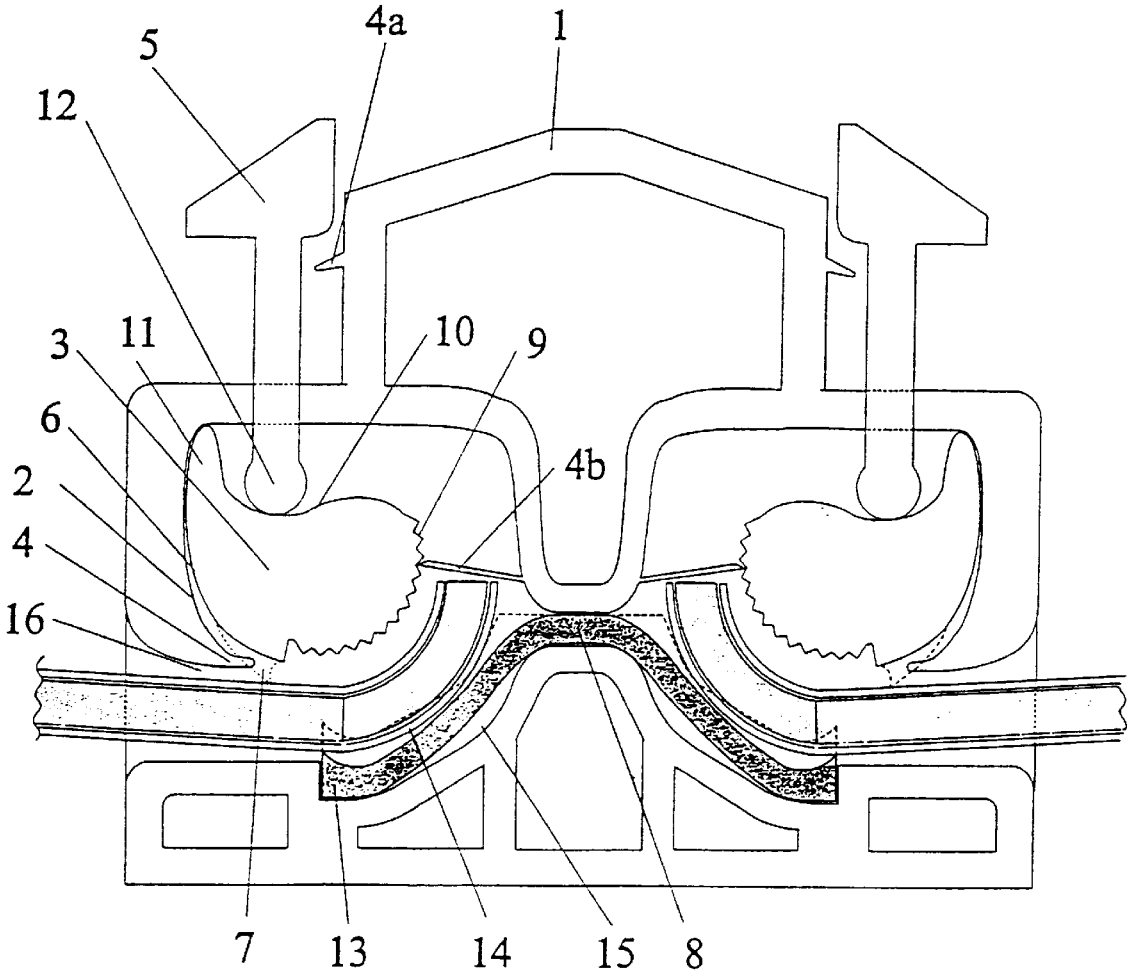

DRAWING 2
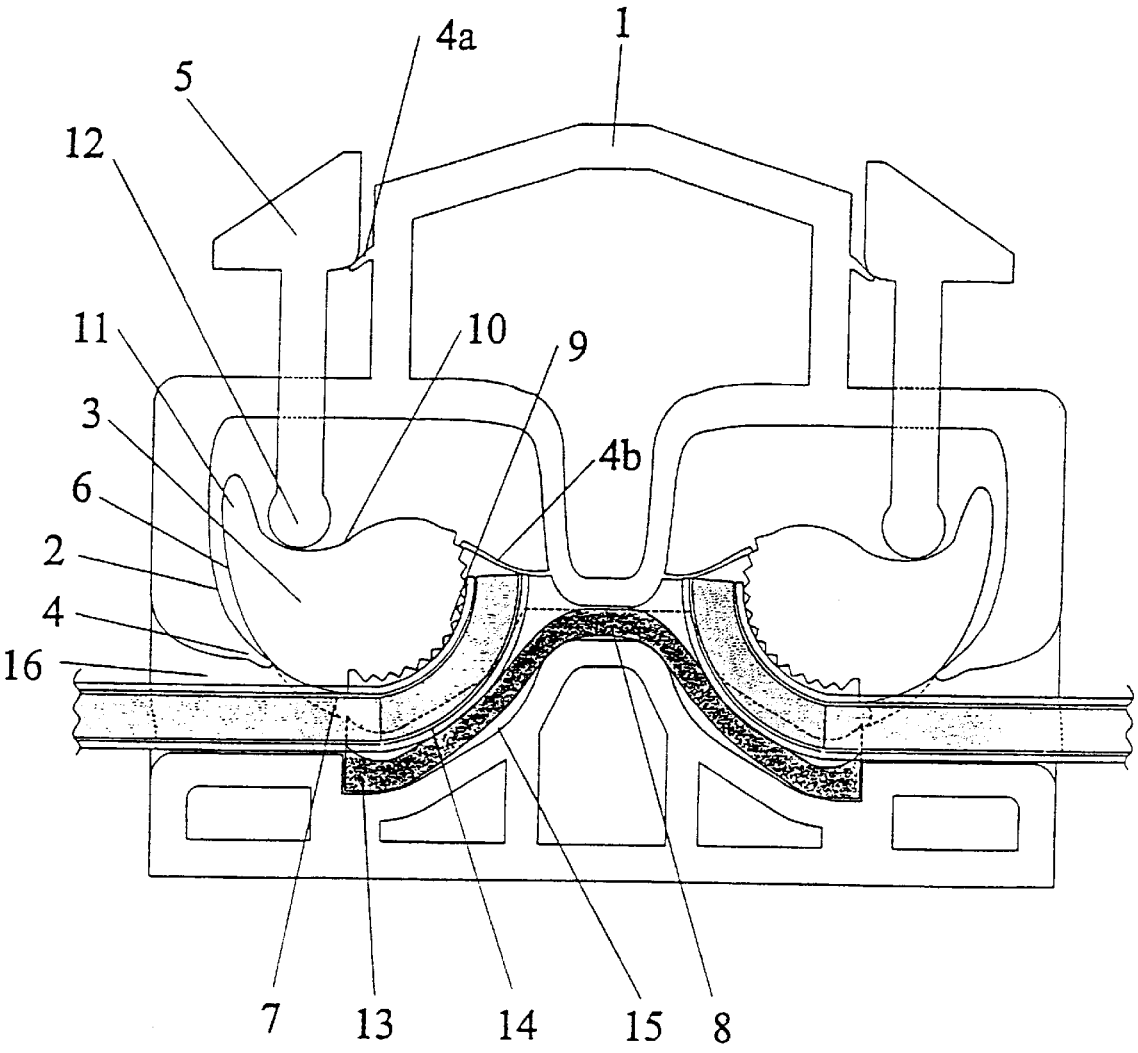

DRAWING 3
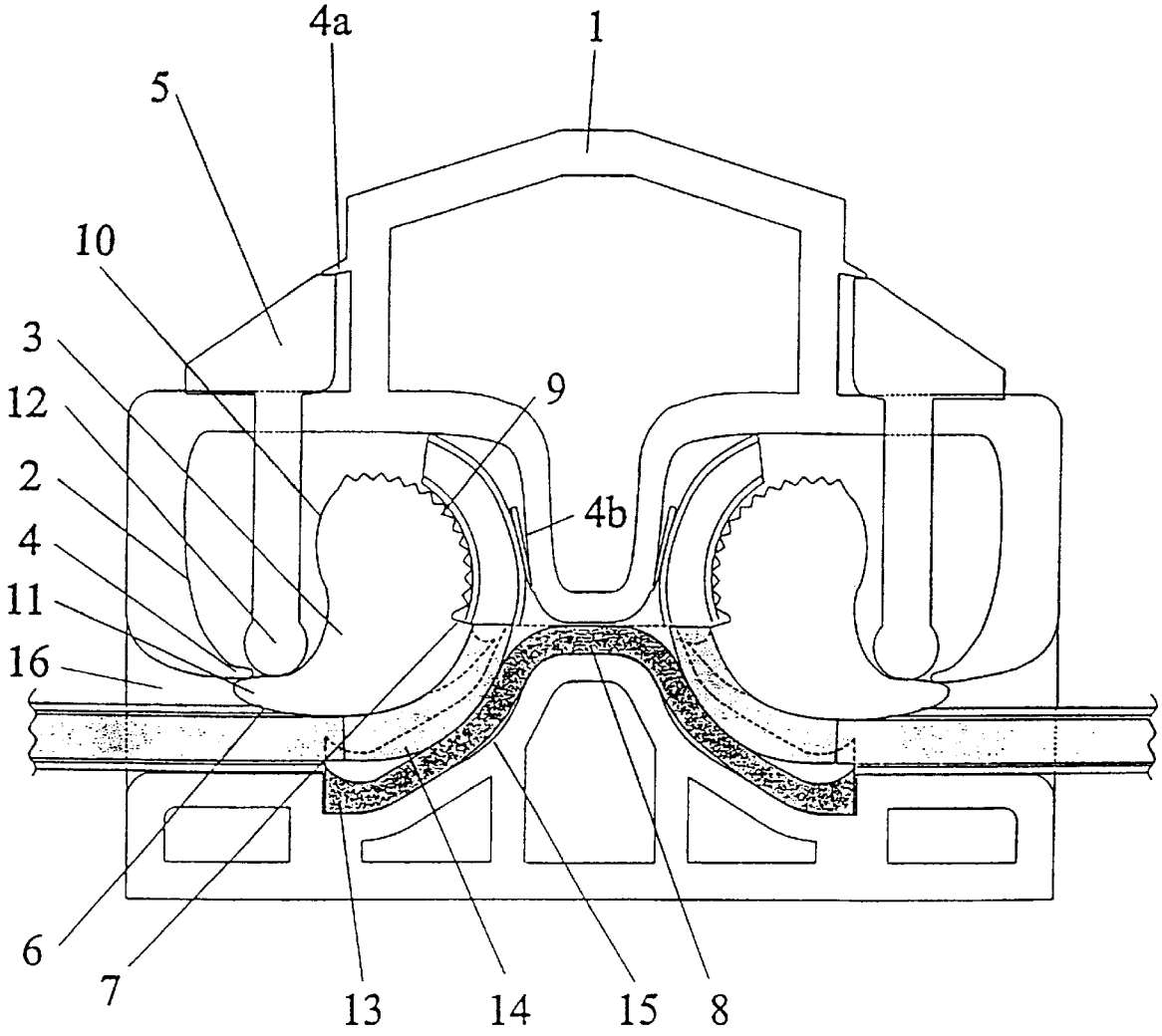

ELECTRICAL CONNECTOR WHICH STRIPS INSULATION FROM AN INSULATED CONDUCTOR

This invention relates to a detachable electric connecting terminal which connects an electric conductor in the form of a wire or strand to an electroconductive contact bar, wherein a pivoting terminal disk forces the conductor against the contact bar when swivelled.

Such a connecting terminal is described in German Patent 904304. In this patent, the conductor is forced against the contact bar by a rocking lever under the intermediate action of a spring. One disadvantage of the known device is that the conductor has to be stripped beforehand. In addition, the contact achieved by the spring is not in the optimal.

U.S. Pat. No. 3,064,227 describes a terminal in which the conductor is not stripped from its insulation beforehand. Since with this kind of connection, the contact element has to be forced between the conductor and the insulation like a lance, this connection is only suitable for soft and flexible insulation. As a result, a strong contact is only achieved when an increased contact force is produced by applying a tensile force at the conductor by means of a bracing spring.

In German Patent Application DE 29 22 447 A1, a terminal is described in which a previously stripped conductor is forced against a contact surface by resilience. The lever which is present serves to push away the friction spring thereby releasing the conductor.

German Patent 29 02 536 discloses a terminal into which a conductor can be inserted without being stripped beforehand. The contact is achieved by cutting the insulation with the cutting edge of a fork-like receptacle. The conductor is pinched against the cutting edge with an insert device.

The object of the invention is to develop a multipurpose connecting technique (usable in terminal blocks, printed circuit connecting terminals or clamping blocks) which, as a cost reduction for the user, makes it unnecessary to strip the conductor beforehand or to use any tools during the clamping operation. Simultaneously, the connection provides a safe and large contact site, protects the conductor from being damaged at the cutting sites and provides a production as simple as possible with few components. The present invention furthermore permits a fast and easy handling which also reduces the cost for both the producer and the user.

The subject matter of the invention is a connecting terminal having the features as given in claim 1. Preferred and advantageous embodiments are defined in dependant claims 2 to 10.

In order to remove the insulation, it is thus advantageous that the terminal disk have a serrated gripping region before the knife, which in addition, acts on the insulation portion. It is also suitable to secure the clamping position by locking or snap-in projections fixed in the housing which act either on the terminal disk or on a slide actuating the terminal disk and which are detachable. For bedding of the terminal disk, it is advantageous if guiding means are provided in the housing on which the outer contour of the terminal disk is supported. The clamping region the terminal disk and the knife for cutting the insulation suitably are adapted to the cross section ofthe conductor. The clamping region of the terminal disk and the contact bar preferably are provided with a semicircular longitudinal groove adapted to the cross section of the stripped conductor. Further, it is advantageous to simultaneously contact several conductors with one clamping operation by connecting several adjacent slides. To improve the effectiveness of clamping, it is favorable when in the clamping region, the contact bar bridges a cavity in the housing like a coach spring and thus performs a resilience. The clamping joint, if required, can be detached with a suitable tool, e.g., a screwdriver, by pushing the housing in the direction against the locking or snap-in nose.

In the following, a preferred embodiment of the invention is described with reference to the following drawings, in which:

FIG. 1 shows the connecting terminal and the conductor introduced therein without being clamped.

FIG. 2. shows the connecting terminal with the knives acting on the insulation during the clamping operation.

FIG. 3. shows the connecting terminal in the clamping state.

The embodiment schematically shows a series terminal in which two conductors 14 are connected by a contact bar 8. Within an insulated housing 1, a terminal disk 3 is pivotedly positioned by guided means 2 fixed in the housing. The terminal disk 3 shows a serrated (toothed) region 9, a knife 7 and a clamping surface 6. By means of a slide 5, the terminal disk is moved into its clamping position, the slide 5 is acting on the upper surface 10 of the terminal disk 3 by means of a plunger 12 (FIG. 1).

Through an opening 16, the conductor 14 is introduced into the housing 1 up to a stopper 4*b*. The conductor 14 with its end portion then sits close to a contact bar 8 provided at its front portion with a counter knife 13. Operating the slide 5, the insulation of the conductor 14 is cut by means of the knife 7 and the counter knife 13 (FIG. 2) and the insulation is removed from the front end of the conductor 14 by means of the serrated region 9 of the terminal disk 3 upon subsequent rotation.

Upon further rotation of the terminal disk 3 by the slide 5, the clamping region comes into contact with the stripped end of the conductor 14 and forces it against the contact bar 8 (FIG. 3). In the clamping region, the clamping bar 8, like the coach spring, bridges a cavity 15 in the housing 1. In the clamping position, (FIG. 3) the terminal disk 3 is fixed by means of a resilient housing projection 4 behind which a locking (snap-in) nose 11 of the termninal disk 3 snaps in. In addition, a further fixation can be produced by a locking projection 4*a* at the housing 1 which acts on the slide 5.

The locking (snapping) joints can be released, if necessary, by pushing against the locking nose 11 with a suitable tool thereby separating the joint. The separation of the locking joint can be achieved by means of a push-button integrated in the housing 1, which is pushed against the locking nose 11 at the opening 16 between the conductor 14 and the resilient housing projection.

I claim:

1. Detachable connecting terminal connecting an insulated electric conductor in the form of a wire or strand with an electroconductive contact bar, fixed in a housing wherein the conductor is introduced into an opening of the housing and a pivoting terminal disk in the housing forces the conductor against the contact bar when swivelled, characterized in that the terminal disk has a knife which together with a counter knife at the contact bar, upon pivoting the terminal disk, separates the insulation from the conductor and upon further rotation of the terminal disk, forces the stripped portion of the conductor with a clamping region adjacent to the knife against the contact bar and where this joint, if necessary, can be separated with a suitable tool by pushing against a locking nose formed on the terminal disk.

2. Connecting terminal according to claim 1, characterized in that the terminal disk additionally has a serrated region before the knife which supports transport of the separated insulation portion.

3. Connecting terminal according to claim 1, characterized in that a resilient housing projection detachable fixes the terminal disk in a clamping position.

4. Connecting terminal according to claim 1, characterized in that the bedding of the terminal disk is achieved by guiding means fixed in a housing, which act on the periphery of the terminal disk.

5. Connecting terminal according to claim 1, characterized in that the clamping region of the terminal disk and the contact bar have a semicircular longitudinal groove adapted to the cross section of the stripped conductor.

6. Connecting terminal according to claim 1, characterized in that the shape of the knife and the counter knife is adapted to the cross section of the insulation to be separated.

7. Connecting terminal according to claim 1, characterized in that in the clamping region, the contact bar bridges a cavity in the housing like a coach spring thereby supporting contact with the conductor.

8. Connecting terminal according to claim 1, characterized in that the terminal disk is operated by a slide being guided in the housing of the connecting terminal.

9. Connecting terminal according to claim 8, characterized in that the slide is fixed in a clamping position by a locking projection at the housing.

10. Connecting terminal according to claim 8, characterized in that by connecting several slides several conductors are simultaneously clamped by one clamping operation.

* * * * *

UNITED STATES PATENT AND TRADEMARK OFFICE

CERTIFICATE OF CORRECTION

PATENT NO. : 6,036,532
DATED : March 14, 2000
INVENTOR(S) : Vera Feistkorn

It is certified that error appears in the above-identified patent and that said Letters Patent is hereby corrected as shown below:

Title page,
Please insert the following information after item [21]:

-- [22] PCT Filed: March 27, 1996
[86] PCT No.: PCT/EP96/01347
§ 371 Date: January 09, 1998
§ 102 (e) Date: January 09, 1998
[87] PCT Publication No.: WO96/35242
PCT Pub Date: November 07, 1996 --

Signed and Sealed this

Seventeenth Day of December, 2002

JAMES E. ROGAN
*Director of the United States Patent and Trademark Office*